United States Patent [19]

Fuchs

[11] 4,084,504

[45] Apr. 18, 1978

[54] MULTIPLE TIER SCREEN PRINTER

[75] Inventor: Alvin J. Fuchs, Milwaukee, Wis.

[73] Assignee: Medalist Industries, Inc., Milwaukee, Wis.

[21] Appl. No.: 791,764

[22] Filed: Apr. 28, 1977

[51] Int. Cl.[2] ..... B41F 15/10; B41F 15/36

[52] U.S. Cl. ..... 101/115; 101/126; 101/128.1

[58] Field of Search ..... 101/115, 123, 124, 126, 101/128.1, 112, 42, 43; 197/53

[56] References Cited

U.S. PATENT DOCUMENTS

| | | | |
|---|---|---|---|
| 83,912 | 11/1868 | Bradford | 101/112 |
| 422,060 | 2/1890 | Robinson | 101/112 |
| 3,427,964 | 2/1969 | Vasilantone | 101/126 X |

FOREIGN PATENT DOCUMENTS

| | | | |
|---|---|---|---|
| 2,132,345 | 1/1972 | Germany | 197/53 |

*Primary Examiner*—Ronald E. Suter

*Attorney, Agent, or Firm*—Wheeler, Morsell, House & Fuller

[57] ABSTRACT

Axially adjacent first, second and third carriages are independently rotatable about a common vertical axis. The first carriage supports a plurality of platens which are spaced from the axis of rotation. The second and third carriages have a plurality of mechanisms which support a circumferentially disposed group of silk screen frames, respectively, for selectively pivoting between an inactive position wherein each screen is at an acute angle with respect to horizontal and an active horizontal position wherein the screen selected for printing is brought into contact with a platen on which there is material to be printed. The lowermost group of screen frames are arranged on the second carriage with at least one angular gap between them when they are in their angulated inactive positions. The uppermost carriage supports another group of screen frames for selectively pivoting between an angulated inactive position and a horizontal active position wherein the screen selected for printing may pass through the gap in the lower group.

6 Claims, 5 Drawing Figures

MULTIPLE TIER SCREEN PRINTER

BACKGROUND OF THE INVENTION

This invention relates to improvements in apparatus for printing on fabrics, paper or similar material typically by means of the silk-screen process.

As is well known, the silk-screen process involves fixing the fabric to be printed upon a suitable surface, placing the silk screen on the fabric and then transferring the color to the fabric by means of a pliable roller or squeegee.

Where several colors are to be printed on the same fabric, an equal number of screens are used successively. This creates the problem of obtaining good registry of the various colors which form the design, numerals or letters being printed. Any solution to the problem has to be consistent with maximizing production rates.

The new apparatus, which achieves good registry of colors at high production rates, will be described in connection with the process of printing numerals on sportswear such as jerseys worn by football players. In particular, the apparatus will be described in connection with the process of printing numbers of one color on the fabric of jerseys and then printing a border of another color at the edge of the first printing so that the numeral is defined by a basic broad area color and a border or rim of another emphasizing color.

Some of the characteristics of the new apparatus to be described herein are generally known as exemplified by U.S. Pat. No. 2,613,595 and U.S. Pat. No. 3,427,964. U.S. Pat. No. 2,613,595 has a circularly arranged group of platens lying in a single plane for supporting fabric or other sheet material which is to be printed on with the silk-screen process. A group of silk screens are mounted for being pivoted toward the platens and for being indexed generally circumferentially to enable printing as many colors on the fabric as there are screens in the group. The screen frames are pivoted individually to a horizontal position for printing and back to an angulated position for indexing or rotating to the next work piece.

U.S. Pat. No. 3,427,964 has several platens on a revolving carriage and lying generally in a horizontal plane. Several platens are carried on another rotating support which is adjacent the carriage and rotatable about the same axis. The rotating support carries several pivotally mounted silk screen frames which are arranged at right angles to each other and which may be used to print several colors consecutively or a single color on a plurality of work pieces.

The above discussed apparatus and apparatus made by applicant heretofore are characterized by having the printing screens arranged in a common plane or single tier. This prohibits achieving certain new functions and objectives efficaciously. A use of the new apparatus is to print large numerals, for instance, on the front or rear of a jersey or other garment in one color and then apply a well registered border, rim or outline of a different color to the basic numeral. Another use is to print numerals on the shoulders or arms of a jersey in one color and to print a border of a different color on these numerals too. The problems of doing this without unsatisfactory registry are evident when one realizes that ten rather large silk screens bearing the digits 0 to 9 are required to produce all of the basic two digit numbers up to 99 and another ten screen frames are required for applying the different colored outlines or rims to these numbers. Heretofore, the need for using the total of twenty screens which are required for this procedure would have dictated use of more than one machine which means that more floor space would be required and that the total investment would be higher than if only one machine were needed as in accordance with the present invention.

SUMMARY OF THE INVENTION

A primary object of the present invention is to provide silk screen printing apparatus wherein the screens for printing one color or one part of a pattern which is to be registered with one or more others are all in one tier and screens for printing other colors or other parts of a pattern are all in one or more other tiers, respectively, and wherein the tiers are arranged coaxially and over substantially the same floor area as if a single tier were used.

Another objective of the invention is to provide an improved printing apparatus to accomplish printing several numerals or other designs on a fabric article and also providing for loading and unloading the apparatus and for heat drying in a quick and easy manner.

Another object is to provide multiple color printing apparatus which, although it has as many tiers of screens arranged in carousel fashion as there are colors to be printed and as many screens in a tier as there are numerals to be printed, is compact as a result of using the same basic mounting mechanism as a single tier machine, and is simple and easy to use.

A more specific object is to provide printing apparatus for the silk-screen process wherein platens for holding articles of clothing in different orientations during printing are carried on a rotatable carriage and where one group of screen carriages for one color or configuration are mounted on a rotating support for being pivoted selectively into contact relation with the platens while still another tier of frames for another color is carried on another coaxial rotatable carriage and mounted for pivoting to make contact with the work piece on the platen such that the screen frames in the upper tier may selectively swing through an angular gap between the frames in the lower tier.

How the foregoing and other more specific objects of the invention are achieved will be evident in the ensuing more detailed description of a preferred embodiment of the invention which will be set forth in reference to the drawings.

DESCRIPTION OF A PREFERRED EMBODIMENT

Figure 1:
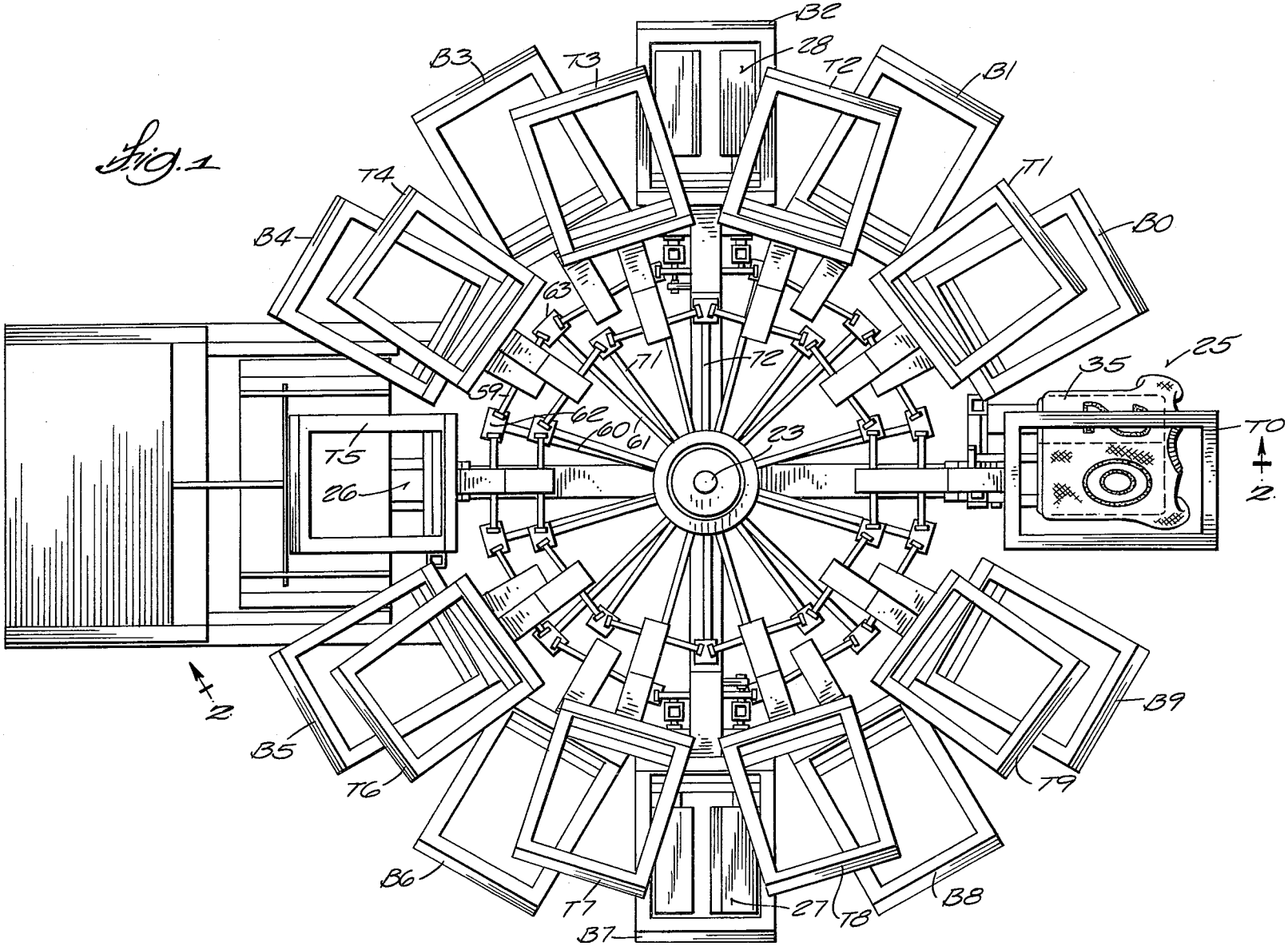
FIG. 1 is a plan view of the printing machine.
Figure 2:
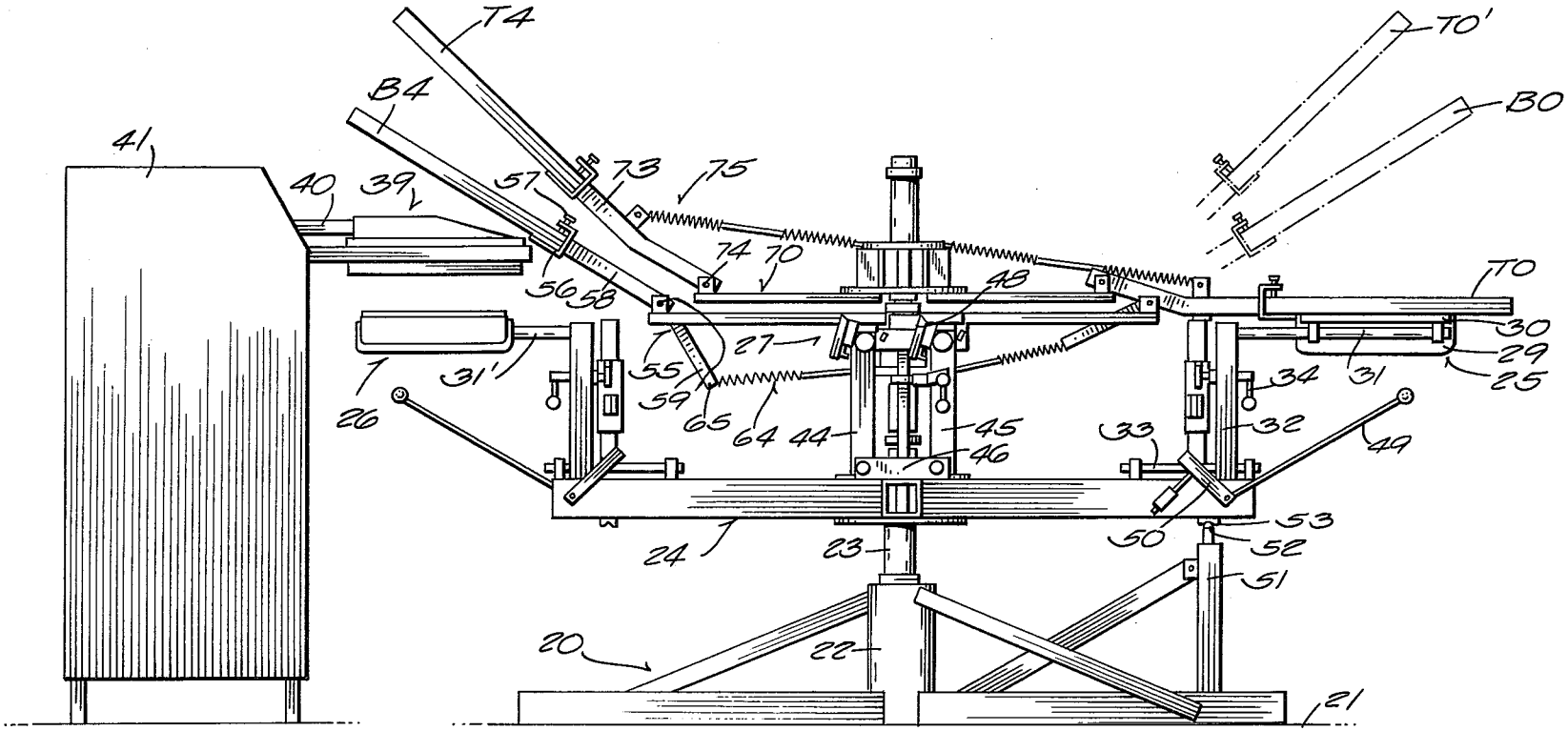
FIG. 2 is a side elevation of the machine with parts omitted for the sake of clarity.

Referring to FIGS. 1 and 2, the machine comprises a base 20 which is fastened to the floor 21. The base has a socket 22 in which a shaft 23 is fixed. A first or lowermost carriage 24 is journaled for rotation in a horizontal plane about shaft 23 which has its axis vertically disposed in this example. Carriage 24 supports four platen assemblies which are designated generally by the numerals 25, 26, 27 and 28. Platen assembly 28 is not visible in FIG. 2 but appears diagrammatically in FIG. 3. Platen assemblies 25 and 26 are of the same type and are adapted for supporting a football player's jersey, for example, when the large numerals are to be printed on the body area between the shoulder area. Platen assemblies 27 and 28 are of the same type and are adapted for printing smaller numbers in the shoulder areas of a jersey, for instance.

Typical platen assembly 25 is comprised of two planar panels 29 and 30 which, if viewed from their ends on a line that is parallel to the drawing as in FIG. 2, can be seen to be at an angle with respect to each other. In other words, the platen panels are adjacent each other but not in the same plane. Panels 29 and 30 are mounted on an arm 31 which is carried by linkage 32 which is, in turn, mounted for pivoting toward and away from the observer on a shaft 33. Linkage 32 is adapted to move in parallelogram fashion to cause panels 29 and 30 to be positioned alternately in a horizontal plane. In FIG. 2, panel 30 of the platen is presently disposed in a horizontal plane and panel 29 is at an angle relative to it. A lever 34 is operable to shift the panel mechanism. The platen structure is illustrative. Various platens may be used, depending on the nature of the work. A jersey 35 which is to be printed is shown on a platen in FIG. 1.

Figure 3:
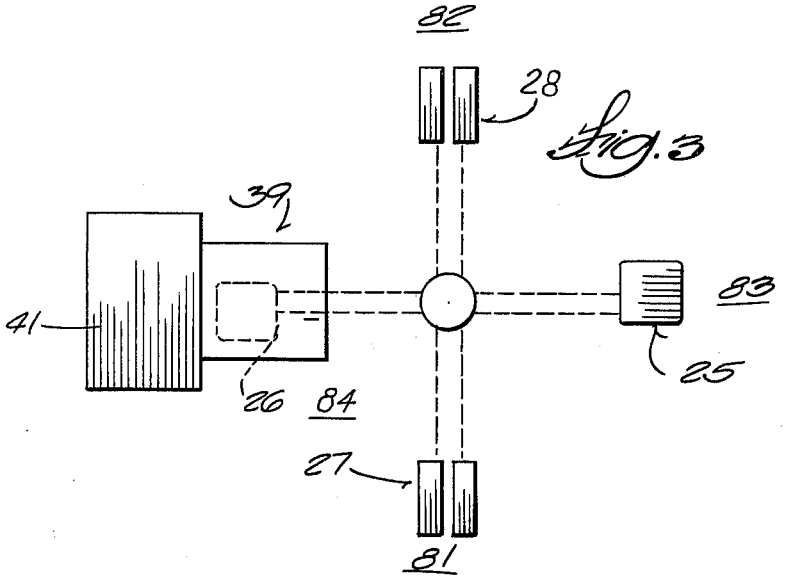
FIG. 3 is a diagram showing the relationship between the printing, loading and unloading stations and the heat curing station.

Platen 25 in FIG. 2 is shown as being rotated with first carriage 24 to a printing position or printing station generally designated by numeral 83 in FIG. 3. Its counterpart, platen assembly 26, is illustrated as being 180° away from platen assembly 25 and is situated at a drying station, designated by 84 in FIG. 3, where a fabric article, not shown, that has been printed and is carried on platen 26 may be dried with heat. Platen assembly 26 is shown in FIG. 2 as being under a heat emitting device 39 which can be raised and lowered on an arm 40 and which can be retracted into a housing 41. The mechanism for actuating heater 39 is not visible and is inside of housing 41. It will be evident that after the printed fabric on platen 26 is dried, rotation of the first and lowermost carriage 24 for the platens will position the platens to enable a person participating in operation of the machine to remove the article and insert another one. At the same time the article which is being printed on platen 25 in FIG. 2 will be in transit toward the heating station. When the article on platen 25 reaches the heating station, the unprinted article on platen 26 will be at the printing station.

The platen assembly 27 at the center and forefront in FIG. 2 is for printing small numbers at the shoulders of the fabric jersey. Its counterpart, 28, is diametrically opposite on platen carriage 24. Platen assemblies 27 and 28 are shown diagrammatically in FIG. 3. Typical platen assembly 27 in FIG. 2 comprises a pair of links 44 and 45 which are adapted to pivot in parallelogram fashion on a base 46 which is mounted on the first carriage 24. The linkage supports two small platen panels 47 and 48. These are small enough to enter the sleeves of a jersey and, when they are rocked into a horizontal plane, to provide a surface on which printing pressure may be developed. Printing of the one or two digit numbers in the shoulder area also occurs at the printing station in which platen assembly 25 is disposed in FIG. 2. The printing and drying sequence for the shoulder numbers is essentially the same as that described above for the big numbers on the back of the jersey between the shoulders.

Platen carriage 24, which is the first and lowermost carriage, may be locked against rotation about the vertical axis of shaft 23 by a spring loaded roller 52 on member 51 which engages in a slotted plate 53 on members 24. Lever 49 locks the platens to their centermost and nearest horizontal position for drying. All parts of the printed letters should be an equal distance from heat unit 39 for uniform drying. It is not necessary in all installations for the first carriage means, that is, platen supporting carriage means 24 to be rotatable about vertical shaft axis 22. The platens could be on stationary floor mounted first support means, not shown, or the carriage could be mounted essentially as shown but not be rotatable. In such case, the object of swinging frames in upper tiers selectively through gaps in lower tiers to print on the platens could still be achieved by rotating the various tiers into the proper angular relation as will become apparent.

The second or intermediate carriage assembly 55 is also journaled for rotation in a horizontal plane around the vertical axis of shaft 23. A group of frames for supporting the silk printing screens are marked B0 to B9. The capital B indicates the screen frames that are in the lower tier of frames mounted on the second carriage. The top tier will be discussed later.

A typical bottom tier screen frame B4, which is visible from the side in FIG. 2, comprises a channel 56 in which a radially inward end of frame B4 is inserted and clamped with a set of hand operated screws such as the one marked 57. Channel 56 is fastened to a bell crank 58. The bell crank is mounted for swinging or pivoting about the horizontal axis of a shaft 59 which is mounted to carriage 55. Carriage 55 is actually comprised of a number of radially extending members such as 60 and 61 in FIG. 1. These members are tied together with plates 62 and 63 on which shaft 59 is mounted so that the bell crank may pivot on it. Typical screen frame B4 in FIG. 2 is maintained at an acute angle with respect to horizontal with a rod and compression spring assembly 64 that pivotally connects with the bell crank by means of a pin 65. Typical frame B4 may be pivoted counterclockwise from the acute angle in which it is shown in FIG. 2 to a horizontal position for placing its silk screen in contact with a fabric jersey stretched on platen 26. The frames such as B4 are not normally pivoted from the inactive angular position in which it is shown to a horizontal position unless the particular frame is over printing station platen 25. When a screen frame in the bottom tier of screens is released after printing, the compression spring assembly 64 restores it to its angular position.

Figure 4:
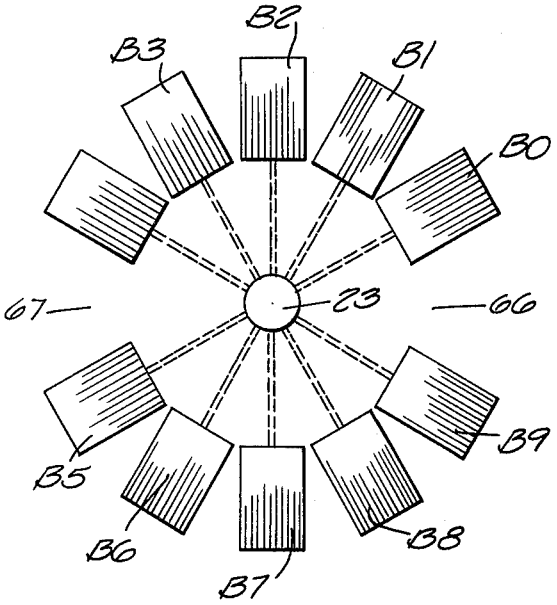
FIG. 4 is a diagrammatic plan view of the lower tier of screen frames.

The arrangement of the bottom tiers B0 to B9 can be readily perceived in the FIG. 4 diagram. One may see that the frames are on pivotal support means or arms and are circumferentially disposed about the axis of shaft 23 and they are equiangularly spaced 30° apart. There are ten frames in FIG. 4 arranged on each side of center in groups of five and there are two angular gaps 66 and 67 between the groups. For the purposes of the invention, only one such gap would be required but another is allowed for the sake of symmetry and balance. Angular gap 66, for example, is defined by the arms which support frames B0 and B9 as seen in FIG. 3 and the angle between these arms is twice as large as the angle between other circumferentially adjacent arms for frames B9 and B8, B8 and B7 and so forth.

It will be evident subsequently that when second carriage 55 is rotated such as to dispose gap 66 over printing station platen 25, a screen frame T0 to T9 from an upper tier of screens, for applying a second color or configuration to the fabric on the platen can be brought down through the gap 66 without interference by any of the screen frames B0 to B9 in the lower tier.

Referring again to FIG. 2, a third carriage 70 is mounted for rotation in a horizontal plane about the vertical axis of shaft 23. This carriage is comprised of radially extending arms such as 71 and 72 in FIG. 1. The group of screen frames T0 to T9 are pivotally supported from carriage 70 and comprise the upper tier of frames. The frames are mounted on arms such as 73 which are connected to the frame with pivot shafts 74. The frames in the upper tier, as typified by frame T4, are held at an acute angle with respect to horizontal as in FIG. 2 by means of tension spring assemblies such as the one marked 75 which is associated with frame T4. Frame T4 and the other frames T0 to T9 in the top tier may be swung down to a horizontal position in opposition to the springs 75 to effect printing engagement with platen 25 at the printing station when a particular top frame is in alignment with one of the angular gaps 66 or 67 in the lower tier of frames. Of course, each frame must be allowed to return to its inclined inactive position before either carriage 55 or 70 can be rotated.

A typical operational sequence will now be described. Referring to FIG. 3, the various loading, unloading, printing and drying stations are marked 81–84. Assume that the large numbers are to be imprinted on the regions between the shoulders of a series of jerseys first. The lowermost platen carriage 24 would be rotated initially to station 81 where a jersey would be fitted onto platen 25. The carriage would then be rotated to dispose platen 25 at printing station 83. The lower tier of frames B0 to B9 would then be rotated by rotating their carriage 55 until the frame which carries the large area digit of the number to be imprinted is in angular coincidence with platen 25 in the printing station. If 0 were the right-hand numeral of the two digit number to be printed, it would be frame B0 which would be located in alignment with platen 25. The platen would then be moved to the far left to place the right half of the platen in the center and in a horizontal plane. Ink would then be applied to the screen with a squeegee, not shown. Then the frame is pressed downwardly until it reaches a horizontal position to make the imprint on the jersey that is supported on the platen. The frame for number 0 would then be released and lower carriage 55 would be rotated until the first digit such as 2 would be swung to alignment with the printing station platen 25. The platen would be moved to the far right to place the left half of the platen on center and in a horizontal plane. After being inked with a squeegee, the screen would be pressed down to a horizontal position for imprinting and released to return to its angulated attitude which is similar to the attitude of frame B0 which is shown in phantom lines in FIG. 2. When the two digits comprising the number are imprinted, bottom frame 55 is rotated to dispose the platen 25 bearing the freshly printed numbers under the dryer 39. At this time, the platen 26 is rotated to station 83 for being loaded with an unprinted jersey. When that jersey is printed, it would be rotated toward drying station 84 in which case the first dried printing on platen 25 would be positioned again at the printing station 83. Now the differently colored outline or border is applied to the previously printed large numbers. The planar face 30 of the platen is, of course, turned to the horizontal position which it was in when the aligned number was imprinted. Also at this time gap 66 is aligned with platen 25 so that the frame bearing the outlined number corresponding to the original number may be pivoted through gap 66 to make its imprint. That frame is then allowed to return to its angulated position as illustrated by frame T0' which is shown in phantom lines in FIG. 2. Top carriage 70 is then rotated to locate the next upper tier frame in the group T0 to T9 that has the outlined numeral corresponding with the next numeral to be outlined or imprinted. The platen would be moved, of course, to dispose planar surface 29 in a horizontal position so as to back up the second numeral on which the outline is to be imprinted. The jersey is then removed from the platen and placed on a flat belt dryer, not shown, for drying the second color and for final drying. Another jersey may then be placed on the platen and the sequence may be repeated.

The smaller numbers are applied to the shoulder areas of the jerseys in a substantially similar sequence except that different screens are, of course, substituted for preferably the lower tier screens B0 to B9 and the platens 27 and 28 which are especially adapted for printing in the shoulder area would be used.

Figure 5:
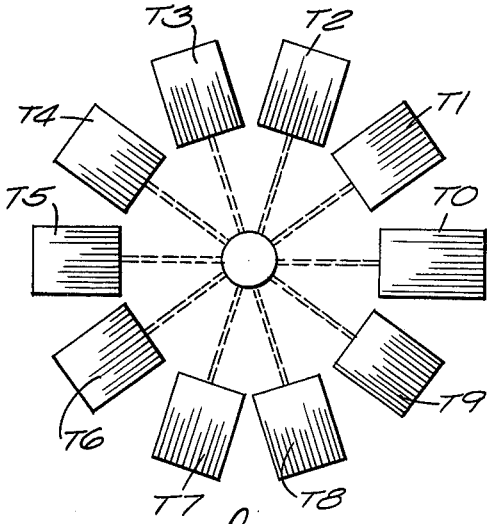
FIG. 5 is a diagrammatic plan view of the upper tier of screen frames.

It may be noted in FIGS. 1 and 5 that the screen frames T0 to T9 in the top tier are at equally spaced 36° angles with respect to each other as compared with the 30° spacing of the frames B0 to B4 and B5 to B9 in the lower tier. The difference in angles between the respective frames in the two tiers permits developing the gap 66 in the lower tier so that a frame from the upper tier can pass through the gap on its way to the printing platen.

It will be appreciated by those skilled in the art that at least another topmost tier, not shown, could be added to the apparatus to enable printing more than two colors on the same object. This may require using both gaps 66 and 67 in the lowermost tier and adding a gap in the top tier of frames so that the frames in the topmost tier may be passed through both gaps on their way to the platen. It will also be appreciated that if the apparatus were used for printing multiple colored patterns other than numbers that groups of screens in the various tiers could be devoted to different colors in which case an unusually large number of colors would be available in a single machine which occupies the least amount of floor space.

Although a specific embodiment of the invention has been described, such description should be considered illustrative rather than limiting, for the invention may be variously embodied and is to be limited only by interpretation of the claims which follow.

I claim:

1. Apparatus for printing on flexible material comprising:

a lower, an intermediate and an upper carriage means arranged axially adjacent each other and mounted for rotation about a common axis, platen means supported by said lower carriage means, a first tier of silk screen supporting means and silk screen means mounted thereon, said supporting means being mounted on said intermediate carriage means for pivoting toward and away from said platen means, said supporting means being spaced angularly about said axis, and a second tier of silk screen supporting means and silk screen means mounted on said supporting means, said supporting means of said second tier being mounted on said upper carriage means for pivoting toward and away from said platen means, said screen supporting means of said second tier being spaced angularly about said axis at angles which permit said supporting means of said second tier to pivot to said platen means in a path between certain of the supporting means in said first tier which is supported on said intermediate carriage means.

2. Apparatus for printing on flexible material comprising:

first support means and platen means mounted thereon for holding said material at a location that is radially remote from an axis, second support means mounted adjacent said platen means for rotation about said axis, a plurality of circumferentially and angularly spaced apart radially extending silk screen supporting means arranged around said axis and being mounted on said second support means for pivoting, respectively, from a position at which they are at an angle relative to a plane to which said axis is perpendicular to a position wherein silk screens respectively supported on said supporting means may contact said platen means, at least two of said silk screen supporting means on said second support means being spaced apart by an angular space which is larger than the space between other of said supporting means, third support means adjacent and axially displaced from said second support means in a direction away from said platen means and mounted for rotation about said axis, and a plurality of circumferentially and angularly spaced apart radially extending silk screen supporting means arranged around said axis and being mounted on said third support means for pivoting, respectively, from a position in which they are more remote in the axial direction from said platen means than are said second support means and are at an angle relative to said plane to a position wherein silk screens respectively supported on said last named supporting means may contact said platen means by passing through said larger space.

3. Apparatus for printing on flexible material comprising:

first support means and platen means mounted thereon for holding said material, second support means mounted adjacent said platen means for rotation about an axis, a plurality of circumferentially and angularly spaced apart radially extending silk screen supporting means arranged around said axis and being mounted on said second support means for pivoting, respectively, from a position at which they are at an angle relative to a plane to which said axis is perpendicular to a position wherein silk screens respectively supported on said supporting means may contact said platen means, at least two of said silk screen supporting means being spaced apart by an angular space which is larger than the space between other of said supporting means, third support means adjacent said second support means and mounted for rotation about said axis, a plurality of circumferentially and angularly spaced apart radially extending silk screen supporting means arranged around said axis and being mounted on said third support means for pivoting, respectively, from a position in which they are at an angle relative to said plane to a position wherein silk screens respectively supported on said last named supporting means may contact said platen means by passing through said larger space, the angle between circumferentially spaced silk screen support means which define said larger space being twice as large as the angle between other successive silk screen support means.

4. The apparatus as in claim 3 wherein:

the sum of the number of silk screen support means and larger spaces for the screen supporting means mounted on said second and rotatable support means divided into 360° yields a certain angle, and the sum of the number of equiangularly spaced silk screen support means mounted on said third and rotatable support means divided into 360° also yields the same angle as said certain angle.

5. Apparatus for printing on flexible material comprising:

first support means and platen means mounted thereon for holding said material, second support means mounted adjacent said platen means for rotation about an axis, a plurality of circumferentially and angularly spaced apart radially extending silk screen supporting means arranged around said axis and being mounted on said second support means for pivoting, respectively, from a position at which they are at an angle relative to a plane to which said axis is perpendicular to a position wherein silk screens respectively supported on said supporting means may contact said platen means, at least two of said silk screen supporting means being spaced apart by an angular space which is larger than the space between other of said supporting means, third support means adjacent said second support means and mounted for rotation about said axis, a plurality of circumferentially and angularly spaced apart radially extending silk screen supporting means arranged around said axis and being mounted on said third support means for pivoting, respectively, from a position in which they are at an angle relative to said plane to a position wherein silk screens respectively supported on said last named supporting means may contact said platen means by passing through said larger space, said silk screen supporting means on said second support means being arranged in two groups wherein the angles between silk screen support means in each group are equal and the angles between groups are twice as large as said angles between said support means in a group.

6. The apparatus as in claim 5 wherein:

there are ten silk screen support means in said two groups and the angles between circumferentially spaced silk screen support means in each group is 30° and the angle defining said larger space between the silk screen support means in adjacent groups is 60°.

* * * * *